United States Patent [19]

Peterson et al.

[11] 4,011,743

[45] Mar. 15, 1977

[54] STAND SPEED REFERENCE CIRCUIT FOR A CONTINUOUS TANDEM ROLLING MILL

[75] Inventors: Robert S. Peterson; John W. Cook, both of Williamsville, N.Y.

[73] Assignee: Westinghouse Electric Corporation, Pittsburgh, Pa.

[22] Filed: Apr. 20, 1976

[21] Appl. No.: 678,527

[52] U.S. Cl. ..... 72/12; 72/240

[51] Int. Cl.[2] ..... B21B 37/00; B21B 37/14

[58] Field of Search ..... 72/6–12, 72/16, 17, 205, 240

[56] References Cited

UNITED STATES PATENTS

| | | | |
|---|---|---|---|
| 3,722,244 | 3/1973 | Fujii et al. | 72/16 |
| 3,807,206 | 4/1974 | Connors | 72/8 |
| 3,852,983 | 12/1974 | Cook | 72/12 |

*Primary Examiner*—Milton S. Mehr
*Attorney, Agent, or Firm*—James J. Wood

[57] ABSTRACT

A stand speed reference circuit is disclosed for providing speed reference signals to each of a plurality of selected stands in a continuous tandem rolling mill.

U.S. Pat. No. 3,852,983 to Cook for "Work Strip Gauge Change During Rolling in a Tandem Rolling Mill" discloses a method for changing to a new gauge schedule without shutting down the mill, by using a precalculated multiplier to successively and progressively change the mill stand speeds of all the stands save the pivot stand, the speed of which remains constant at the previously scheduled rate. Interstand tension regulators between the stands automatically change the delivery gauge at the stand of entry of the gauge change point of the moving strip.

The present disclosure provides an analog stand speed reference circuit to realize the Cook teaching without disturbing the mill by introducing spurious interstand tensions.

8 Claims, 6 Drawing Figures

FIG. 6

| | | RS1 STAND ONE | | RS2 STAND TWO | | RS3 STAND THREE | | RS4 STAND FOUR | | RS5 STAND FIVE | |
|---|---|---|---|---|---|---|---|---|---|---|---|
| | INPUT GAUGE $H_0$ | DELIVERY GAUGE $H_1$ | SPEED $S_1$ | DELIVERY GAUGE $H_2$ | SPEED $S_2$ | DELIVERY GAUGE $H_3$ | SPEED $S_3$ | DELIVERY GAUGE $H_4$ | SPEED $S_4$ | DELIVERY GAUGE $H_5$ | SPEED $S_5$ |
| GAUGE SCHEDULE 1 | .110 | .085 | 446 | .065 | 583 | .050 | 758 | .042 | 903 | .038 | 1000 |
| GAUGE CHANGE TRANSITION AT STAND ONE | .100 | .070 | 446 | .065 | 583 | .050 | 758 | .042 | 903 | .038 | 1000 |
| PER UNIT MULTIPLIER | | $\frac{(S_{21})(H_{22})}{(S_{11})(H_{12})}$ =.933 | | | | | | | | | |
| GAUGE CHANGE TRANSITION AT STAND TWO | .100 | .070 | 416 | .050 | 583 | .050 | 758 | .042 | 903 | .038 | 1000 |
| PER UNIT MULTIPLIER | | $\frac{(S_{31})(H_{32})}{(S_{21})(H_{22})}$ =.937 | | | .937 | | | | | | |
| GAUGE CHANGE TRANSITION AT STAND THREE | .100 | .070 | 390 | .050 | 546 | .036 | 758 | .042 | 903 | .038 | 1000 |
| PER UNIT MULTIPLIER | | $\frac{(S_{41})(H_{42})}{(S_{31})(H_{32})}$ =.794 | | | .794 | | .794 | | | | |
| GAUGE CHANGE TRANSITION AT STAND FOUR | .100 | .070 | 310 | .050 | 433 | .036 | 602 | .024 | 903 | .038 | 1000 |
| PER UNIT MULTIPLIER | | $\frac{(S_{51})(H_{52})}{(S_{41})(H_{42})}$ =.921 | | | .921 | | .921 | | .921 | | |
| GAUGE CHANGE TRANSITION AT STAND FIVE | .100 | .070 | 286 | .050 | 400 | .036 | 555 | .024 | 833 | .020 | 1000 |
| GAUGE SCHEDULE 2 | .100 | .070 | 286 | .050 | 400 | .036 | 555 | .024 | 833 | .020 | 1000 |

STAND SPEED REFERENCE CIRCUIT FOR A CONTINUOUS TANDEM ROLLING MILL

CROSS REFERENCE TO RELATED APPLICATIONS

None

BACKGROUND OF THE INVENTION

In the operation of prior art tandem rolling mills it has been necessary to roll the entire length of metal strip material on one coil to a single specified thickness. That is, there had been no satisfactory way of changing gauge while the strip material was in motion.

U.S. Pat. No. 3,807,206 to Connors for "Strip Gauge Change During Rolling in a Tandem Rolling Mill" provided one solution for changing gauge under dynamic conditions. According to the teachings of this patent the speed and roll gauge setting of the first stand are changed. Thereafter in timed sequence the roll gap settings and speeds of succeeding stands are changed until all roll gap settings and speeds of the stands in the mill have been changed to accommodate a new gauge rolling schedule.

U.S. Pat. No. 3,852,983 to Cook for "Work Strip Gauge Change During Rolling in a Tandem Rolling Mill", addressing itself to the same problem, proposes to make the changes in stand speed and roll gap setting in a different manner. Cook teaches the utilization of a precalculated per unit multiplier to successively and progressively change the mill stand speeds of all the stands save the pivot stand, the speed of which remains constant at the previously scheduled rate. Interstand tension regulators between the stands automatically change the gauge at the stand of entry of the gauge change point of the moving strip of material.

The present invention provides an analog stand speed reference circuit to realize the teachings of Cook, and insure that the changes in stand speed are made at the same rate and at the same time in order to prevent spurious interstand tensions from developing. For example in a five stand mill at the gauge change transition at stand 3, the speeds of stands 1 and 2 are changed and the gauge but not the speed at stand 3 is changed. If the speed changes at stands 1 and 2 are not made at the *same time and the same rate*, a spurious interstand tension will develop between stands 1 and 2 and the interstand tension regulator will attempt to change the roll gap opening at stand two. Since the roll gap opening at stand two had already been changed to its proper and new schedule magnitude, this would result in a hunting of the interstand regulators and cause off gauge material to be rolled. The present invention insures that the speed changes are made at the same time and in unison.

SUMMARY OF THE INVENTION

In accordance with the present invention there is provided in a continuous rolling mill a stand speed reference circuit for supplying a speed reference to each of a plurality of selected stands respectively. Speed reference means are provided for deriving a variable potential and for delivering said speed reference signal. Means are coupled to said speed reference means for storing a voltage signal which is a function of said variable potential. First summation means receive the stored voltage signal and the instantaneous magnitude of said variable potential and deliver a first summation signal. A ramp function generator means is provided for receiving a signal (1-P.U.) during the transitional change in gauge, the P.U. being $$P.U. = \frac{S(i+1)1\ H(i+1)2}{S(i)1\ H(i)2}$$

where $S(i+1)1$ = the original schedule (1) stand speed of the transition stand;
$S(i)1$ = the original schedule (1) speed of the stand next behind the transition stand;
$H(i+1)2$ = the new schedule (2) roll gauge for the transition $(i+1)$ stand;
$H(i)2$ = the new schedule (2) roll gauge for the ith stand;

and for delivering a voltage which is a function of the incremental desired change in speed for all stands being then changed in speed. Multiplying means are connected to receive and multiply the stored voltage and said incremental desired change voltage and to deliver a product voltage. A second summation means is connected to receive said first summation signal and said product voltage, and to deliver an error voltage. Control means are connected to receive a first schedule stand speed reference and said error signal and to deliver a control signal to said speed reference means, the magnitude of said variable potential being successively a function of said first schedule stand reference and said error signal respectively. Finally, means are provided for controllably interrupting the connection of said first schedule stand reference signal and said error signal to said control means, and for controllably decoupling said storing means from said variable potential, the stored voltage upon decoupling being the input to said first summation means, so that said error signal is applied to said control means only when the associated stand speed is to be changed upon making a gauge change in the rolling schedule.

BRIEF DESCRIPTION OF THE DRAWINGS

FIG. 6 is a chart illustrating the use of the per unit multiplier signals from the digital computer, in changing the speeds of the stands in accordance with a new rolling schedule, and particularly showing the progression of speed and delivery gauge changes as the gauge change transition proceeds through the stands of the rolling mill.

DESCRIPTION OF THE PREFERRED EMBODIMENT

Figure 1:
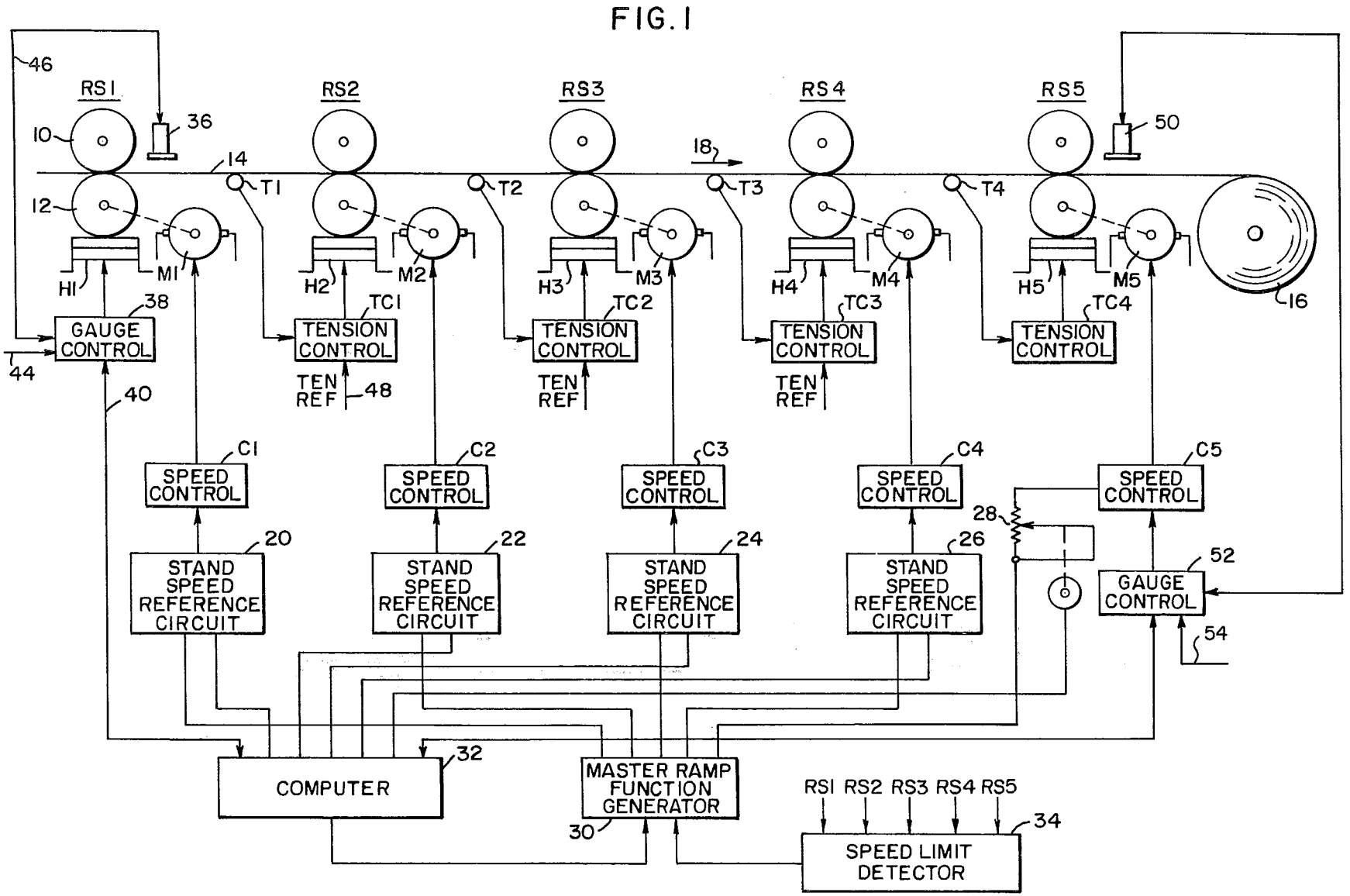
FIG. 1 is a block schematic diagram of a continuous rolling mill incorporating the stand speed reference circuit in accordance with the instant invention.

With reference now to the drawings, and particularly to FIG. 1, the system shown includes a five-stand tandem rolling mill including stands RS1, RS2, RS4 and RS5. Each stand comprises a pair of work rolls 10 and 12, between which strip material being rolled passes, together with a pair of backup rolls, not shown. The strip issuing from the last stand RS5 is wound on a coiler 16, the direction of strip movement being from left to right as indicated by the arrow 18 in FIG. 1. The rolls of each stand are driven by means of drive motors M1, M2, M3, M4 and M5, each controlled by a speed control circuit C1, C2, C3, C4 and C5, respectively. The speed control circuits C1–C4 are coupled to the stand speed reference circuitry of this invention viz. 20, 22, 24, 26, while speed control circuit C5 is connected to a preset MOR (motor operated rheostat) indicated generally at 28. As will be explained in greater detail in the discussion of FIG. 2 during the first rolling schedule, a master ramp function generator 30 sends a signal to the stand speed reference circuits 20, 22, 24, 26 and to the preset MOR 28, which establishes a nominal or desired speed for each of the stands in the mill and at the desired exit speed from stand RS5. The input to the master ramp function generator 30 may be from a computer 32 which provides the mill speed reference or it may be provided manually by an operator supplying this reference by means of dials, thumb wheels, push bottons or the like.

If the mill is reducing gauge, the speed of the material issuing from any stand must be greater than that entering the stand in accordance with the well known constant volume principle. Accordingly, the speed of stand RS2 must be greater than that of stands RS1; the speed of stand RS3 must be greater than that of stand RS2 and so on, the exit speed from stand RS5 being the greatest.

A speed limit detector 34 monitors the speed from all the stands RS1, RS2, RS3, RS4 and RS5, and sends a stop signal to the master ramp function generator 30 when any one stand has reached its maximum speed.

In the embodiment of the invention shown herein, the chocks supporting the rolls in each stand are loaded by means of hydraulic cylinders H1, H2, H3, H4 and H5, respectively. That is, the hydraulic cylinders H1–H5 provide the necessary roll force to reduce the strip 14 in thickness, and while only one cylinder is shown for each stand in the schematic illustration of FIG. 1, it will be understood that in an actual rolling mill there are hydraulic cylinders on opposite sides of the mill, loading each of the chocks at the opposite ends of the rolls. It is of course, possible to use a mechanical screwdown mechanism or a wedge-type control to effect somewhat the same results; however, hydraulic cylinders are preferred because of their speed of operation.

The gauge of strip material passing through the first stand RS1 is measured by means of an X-ray gauge or the like. Gauge 36 produces an electrical signal proportional to the gauge error of the strip gauge between stands RS1 and RS2, and this signal is applied to a gauge control circuit 38. The X-ray gauge 36 and the gauge control 38 are set for the desired strip thickness gauge out of stand RS1 by the computer 32 over cables 40 and 46. If the actual gauge at the output of stand RS1 does not match the desired gauge as determined by the setting of the X-ray gauge 36 a corresponding error voltage will be transmitted from the X-ray gauge 36 over cable 46 to the gauge control 38. The gauge control circuit 38, through appropriate hydraulic controls not shown, either increase or decrease the pressure on cylinder H1 to increase or decrease the roll force and/or roll gap and thereby vary the gauge of material issuing from stand RS1 until it matches the desired gauge. Input 44 to the gauge control 38 represents a manual adjustment which could come from a device such as a digital thumbwheel or a potentiometer.

Between successive stands are the tensiometers T1, T2, T3 and T4 which measure tension in the strip between each set of stands. The tensiometer T1, for example measures the tension in the strip material 14 between stands RS1 and RS2 and produces an electrical signal proportional thereto. This tension signal from tensiometer T1 is compared in tension control circuit TC1 with a tension reference signal on lead 48 proportional to the desired tension; and if the two are not the same, then the tension control circuit TC1 through appropriate hydraulic controls, not shown, will vary the pressure exerted by cylinder H2 for stand RS2, thereby varying the roll gap opening and/or roll force of stand RS2. Similar tension control circuits TC2–TC4 are provided for stands RS3–RS5 respectively. Each tensiometer measures the interstand tension and compares it with a tension reference signal; and if the two are not the same, then the roll gap opening for the succeeding stand is varied.

Let us assume, for example, that the tension between stands RS2 and RS3 increases. Under these circumstances, comparison of the increased tension signal from tensiometer T2 with the tension reference signal will act to decrease the roll gap of the rolls on stand RS3 until the tension is reduced to the desired value. Similarly, if the tension between stands RS2 and RS3 should fall, then comparison of the tension signal from tensiometer T2 with the tension reference signal will act to increase the roll gap until the tension rises to the desired value. All of this, of course, assumes that the speeds of the stands remain constant. The final output gauge of the strip material passing through the tandem rolling mill is measured by means of an X-ray gauge 50 or the like which produces an electrical signal proportional to the gauge error of the strip being delivered from stand RS5. This error signal is applied to the gauge control 52 where it causes the speed of stand RS5 to change by an amount to reduce the gauge error to zero. The X-ray gauge 50 and the gauge control 52 are set for the correct strip thickness either from the computer 32 or from the manual input 54 in a manner similar to the stand RS1 set up. As described the function of the gauge control circuit 52 will be to apply an error signal to the speed control circuit C5 to incrementally either increase or decrease the speed of motor M5 on stand RS5 to provide vernier correction for any variations from desired gauge. However, as we shall see in most cases only the roll gap opening on stand RS5 will require change and not the stand speed.

As was explained above, mills of this type normally operate by rolling a continuous length of strip on a coil to a single specified thickness or gauge along the entire length of the strip. However situations arise where it is desired to change the gauge of the strip material on a single coil while it is in motion and being rolled. This may happen, for example, on small orders where, in the past, it has been necessary to roll a single coil of strip material of limited length. This requires shutting down the mill between successive small coils, and resetting the speed and gauge references after each coil is rolled.

In accordance with the teachings of U.S. Pat. No. 3,852,983 to Cook for "Work Strip Gauge Change During Rolling in a Tandem Rolling Mill", when it is desired to change the delivery gauge during the rolling of a single work strip, the roll gap setting of only the first stand RS1 is changed. This may be accomplished by computer 32 sending a signal to the gauge control 38 and X-ray gauge 36 for the new desired thickness. The X-ray gauge 36 then senses the error in strip thickness exiting from RS1 and sends an error signal to the gauge control 38 which will actuate the hydraulic cylinder H1 to provide the requisite force to change the roll gap to reduce the gauge error to zero. Thereafter, according to the teaching of Cook once the initial roll gap setting has been changed, when the transition part or locus of the strip reaches the next stand in the path of travel, the speed of the first stand will then be changed based on a precalculated signal (per unit multiplier) sent by the computer 32.

When the gauge change transition reaches stand RS2 with the first and second stands now at a new speed ratio the tensiometer T1 will measure the tension in the strip material 14 between the stands and produces an electrical signal proportional thereto. This tension signal from tensiometer T1 is compared in tension control circuit TC1 with a tension reference signal on lead 48 proportional to the desired tension; since the two are not the same, then the tension control circuit TC1 through appropriate hydraulic controls, not shown, will vary the pressure exerted by the cylinder H2 for stand RS2, thereby varying the roll gap opening and/or roll force of stand RS2. Similar tension control circuits TC2, 3 and 4 are provided for stands RS3–RS5 respectively. Each tensiometer T1, T2, T3 and T4 measures the interstand tension and compares it with a tension reference signal, to thereby vary the roll gap opening of the succeeding stands.

In contemplation of the Cook patent, the roll gap openings are changed automatically by the tension control for the one stand at the transition point whereas the stand speeds are changed for all stands behind the transition stand i.e. the stand where the roll gap opening is changed. When the pivot stand is reached only its roll gap opening is changed to conform with the new roll schedule, while its speed remains *constant* at the previously scheduled rate. By definition then the pivot stand is the stand where the speed is not changed.

A consideration of the chart of FIG. 6 will serve to make clear the rationale of this technique. Assume that the mill is rolling on the gauge schedule 1 shown in the top line viz. the delivery gauge H1 is 0.085 at a speed of 446 ft. per min., the material has a delivered gauge H5 = 0.038 at stand RS5 at an exit speed equal to 1000ft. per min. Assume that it is now desired to change the rolling schedule to a second gauge schedule say 0.020 as shown on the bottom line. This is accomplished in successive stages as a predetermined gauge change point passes through the mill stands. The gauge change point can be readily determined and monitored in any one of several ways. For example a weld detector may be used to sense the gauge change point in the form of a welded joint on the work strip. In another arrangement a pulse generator and a bridle roll cooperating with a pulse counter may be used to count the number of feet of strip to track the gauge change point through the mill. A gauge change transition occurs as the gauge point successively enters stands: RS1, RS2, RS3, RS4 and RS5.

Assume now that the operator wishes to roll on gauge schedule 2 shown on the bottom line of the chart i.e. the gauge is to be reduced to 0.020 at an exit speed of 1000 ft. per min. This is accomplished by first changing the gauge at stand RS1 to 0.070. Note this is the only change made during the gauge change transition at stand RS1. As previously explained this is accomplished by the computer 32 sending a signal to the gauge control 38 and the X-ray gauge 36. The X-ray gauge 36 provides an error signal to the gauge control 38 which will actuate the hydraulic H1 to provide the proper force to change the roll gap opening in such direction to reduce the gauge error to zero. As will be explained later in the discussion of FIGS. 2–5 when the gauge change point enters stand RS2, the computer provides a per unit multiplier signal to the stand speed reference circuit 20 which changes the speed of stand RS1. In the example of FIG. 6, this per unit multiplier is:

$$\frac{(S21)\,(H22)}{(S11)\,(H12)} = .933$$

The speed of stand RS1 is changed:

$$(446)\,(0.933) = 416.118 \approx 416$$

At the gauge change transition when the strip enters RS2, the interstand tension between RS1 and RS2 is now changed and tensiometer T1 senses the change, sends a tension signal to the tension control TC1 which compares the received signal with the tension reference 48. The hydraulic cylinder H2 is then displaced to change the roll gap opening so that the interstand tension is equal to the desired magnitude; in the situation we are considering in FIG. 6 this is from 0.065 to 0.050. Note that stands RS3, RS4 and RS5 are unchanged in all respects at this time.

When the gauge change transition is at stand RS3, the speed of stand RS1 is changed to 390, the speed of stand RS2 is changed to 546 and the gauge H32 is changed to 0.036—stands RS4 and RS5 are unchanged at this point. The mathematics is as follows:

Speed of stand (old schedule) × per unit multiplier = speed of stand 2 (new schedule)

$$(416) \times 0.937 = 389.792 \approx 390$$

$$(583) \times 0.937 = 546.271 \approx 546$$

Similarly, the gauge change transition at stand 4 changes the speeds of RS1, RS2, RS3 and the gauge at stand RS4. Finally, at the gauge change transition at stand RS5, the speeds of stands RS1, RS2, RS3 and RS4 are changed and the delivery gauge at stand 5 is changed to 0.020 by the action of tension control TC4. In summary, the speed of stand RS1 has been changed four times, the speed of stand RS2 has been changed three times, the speed of stand RS3 has been changed twice, the speed of RS4 has been changed only once and the speed of stand RS5 (the pivot stand) has not been changed at all. The gauge at each stand is only changed once, i.e. at the gauge change transition.

Figure 2:
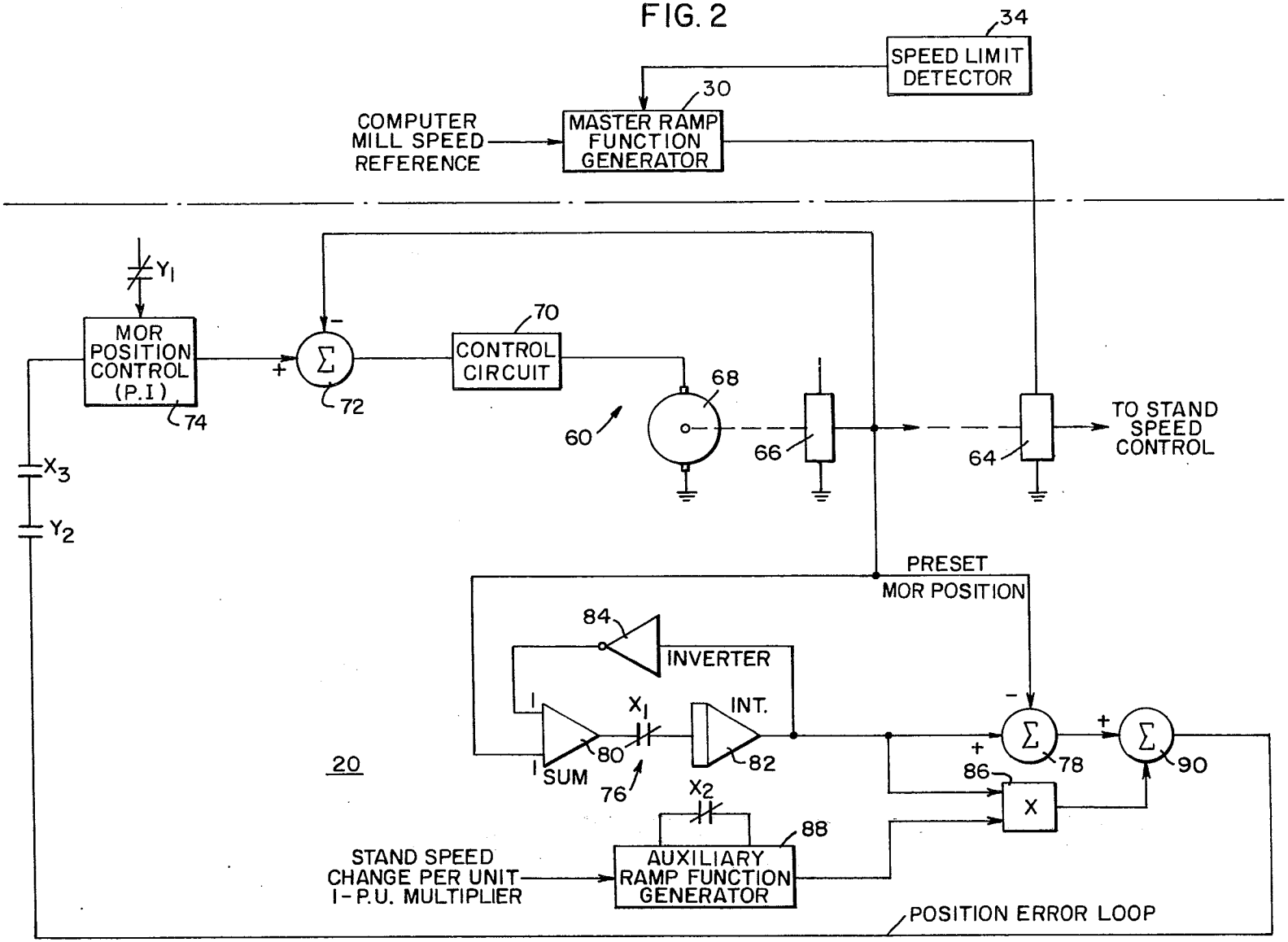
FIG. 2 is an electrical block schematic of the stand speed reference circuit in accordance with this invention.

The pivot stand RS5 does not have its speed changed only the roll gap opening is changed. Any stand could be the pivot stand. For example, if stand RS4 is the pivot stand its speed will not be changed, and when the transition passes through stand RS5, its speed must be changed in the opposite direction to the changes in the first three stand speed changes to obtain the correct speed relationship out of stand 5. After the pivot stand, the speeds of the entry stands before the pivot are not changed when the transition passes through a stand on the delivery side of the pivot stand. The per unit multiplier can be stated generally as $$P.U. = \frac{S(i+1)1\ H(i+1)2}{S(i)1\ H(i)2}$$

where S(i+1)1 = the original schedule (1) speed of transition stand;
S(i)1 = the original schedule (1) speed of the stand next behind the transition stand;
H(i+1)2 = the new schedule (2) roll gauge for the transition stand (i+1)
H(i)2 = the new schedule (2) roll gauge for the ith stand The stand speed reference circuit 20 of the invention is shown in FIG. 2. (Note the circuit of FIGS. 2–5 includes two relays, only the contacts of which are shown in the interests of simplicity). An identical speed reference circuit is provided for each stand except the pivot stand which in this illustrative embodiment is stand RS5. The speed controls C1, C2, C3 and C4 receive the speed reference signal from a stand preset MOR (monitor operated rheostat). In FIG. 2, assume that the circuit 20 is for speed control C1. The stand preset MOR indicated generally at 62 comprises potentiometers 64, 66 which have their respective taps or wipers ganged together and coupled to the shaft of a motor 68 so that they move in unison upon rotation of the motor shaft. The rotation of the motor is under the discipline of control circuit 70 which receives its signals from the output of summation point 72. One input signal to the summation point 72 is from the MOR position control 74 which is an operational amplifier connected to operate either as an amplifier or as a proportional integrator. The other input to the summation point 72 is from the wiper of potentiometer 66. The wiper of potentiometer 66 is connected to a storage or memory circuit indicated generally at 76, and to a summation point 78. The wiper of potentiometer 66 is connected to a summer 80. The output of summer 80 is connected to an integrator 82 through normally closed relay contacts X1. The output of the integrator 82 is applied to summation point 78, and through an inverter 84 back to the input of summer 80. The output of the integrator 82 is also connected as one input to a multiplier 86, the other input being from an auxiliary ramp function generator 88. The output of the multiplier 86 is applied to summation point 90 the output of which is applied through normally open relay contacts X3 and Y2 to the MOR position control 74.

Figure 3:
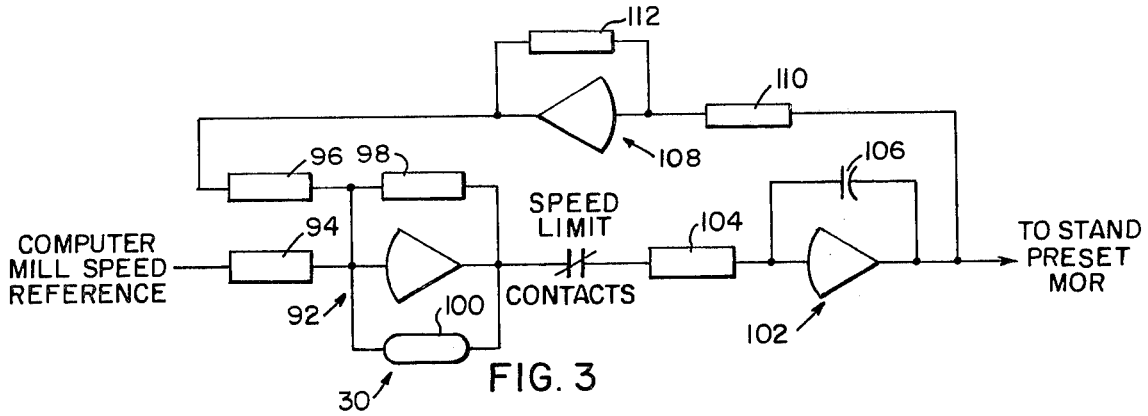
FIG. 3 is a block diagram of a master ramp function generator.

The master ramp function generator 30 is shown in greater detail in FIG. 3. The mill speed reference from the computer 32 is applied to an operational amplifier 92 which is connected as a high gain summer. The mill speed reference is connected to resistor 94. The operational amplifier 92 includes input resistor 96, feedback resistor 98 and a limiter indicated symbolically at 100. Resistors 94 and 96 are of equal ohmic magnitude, and the ohmic magnitude of 98 is >>> than that of resistor 96. The output of the amplifier 92 is through the normally closed (unnumbered) contacts of the speed limit detector 34 to an operational amplifier 102 connected as an integrator and having input resistor 104 and a capacitor 106 in its feedback path. The master ramp output is fed back to a resistor 96 through an inverter indicated generally at 108, and having resistors 110 and 112.

Figure 4:
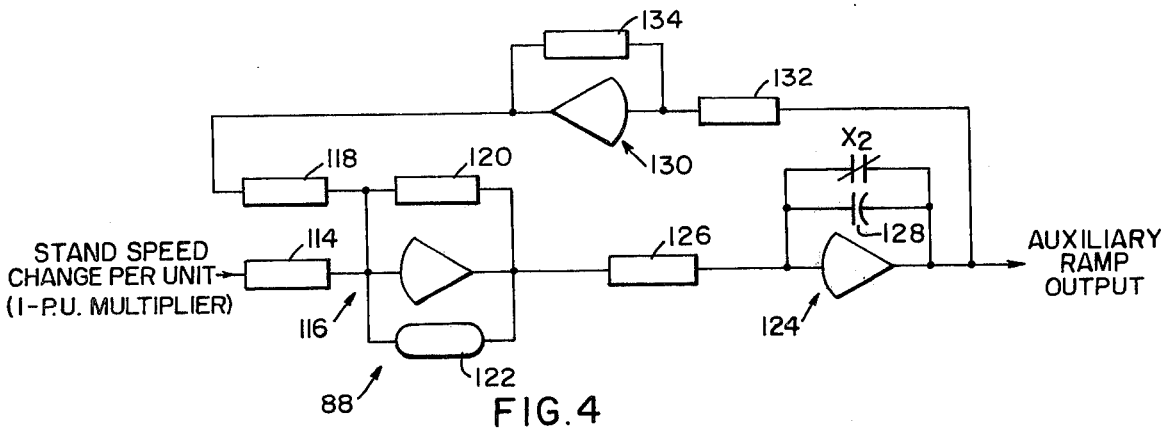
FIG. 4 is a block diagram of the stand auxiliary ramp function generator utilized in the circuit of FIG. 2.

The stand auxiliary ramp function generator 88 is shown in greater detail in FIG. 4. The stand speed change per unit (1-P.U. multiplier) is applied through a resistor 114 to an operational amplifier indicated generally at 116, connected as a high gain summer. The amplifier 116 also includes resistors 118, 120 and a limiter 122. The output of the summer 116 is connected to an operational amplifier indicated generally at 124, connected as an integrator and having an input resistor 126 and a feedback capacitor 128. The capacitor is shunted by normally closed contacts X2. The output of integrator 124 is connected to the input resistor 118 of summer 116 through an inverter indicated generally at 130 and having resistors 132, 134.

Figure 5:
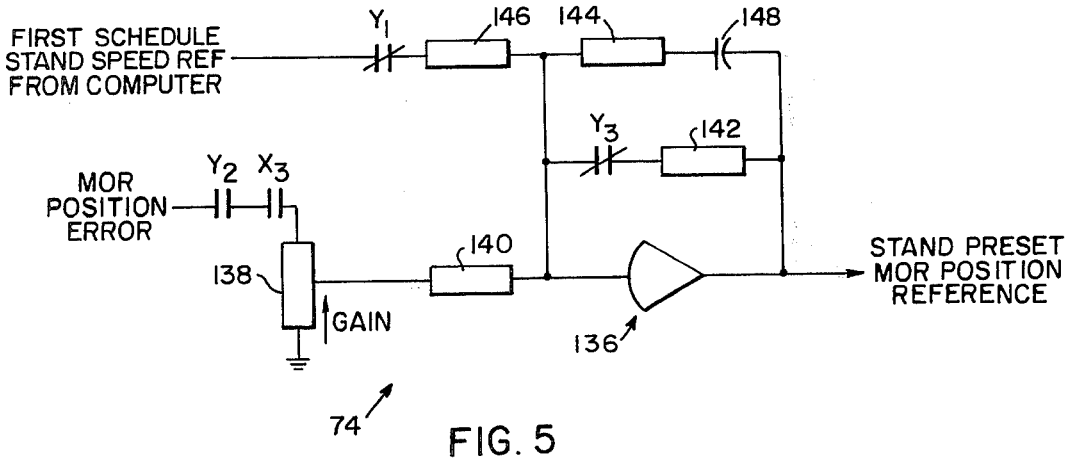
FIG. 5 is a block diagram of the MOR position control utilized in the circuit of FIG. 2.

The MOR position control 74 is shown in greater detail in FIG. 5. The MOR position error is applied through normally open contacts Y2 and Y3 to an operational amplifier indicated generally at 136 connected as a proportional integrator. The input signal is applied to a potentiometer 138 which may be adjusted to change the gain. The operational amplifier 136 includes resistors 140, 142, 144 and 146 and a capacitor 148.

OPERATION

When the mill is initially being threaded, relays X and Y are deenergized. The computer 32 sends a signal to the master ramp function generator 30 which provides a potential to the potentiometer 64. The MOR position control 74 (FIG. 5) receives a signal from the digital computer which in turn sends a signal to the summation point 72 to provide an error signal to drive the motor 68. The turning of the motor 68 displaces the wipers on the potentiometers 64, 66 so that in effect a portion of the potential supplied by master function generator 30 is picked off to establish the stand speed. When the relay Y is deenergized, the MOR position control 74 acts as a proportional amplifier. This action takes place at each of the stands RS1, RS2, RS3 and RS4.

When the first schedule changes are completed, relay Y is energized. Now contacts Y1 and Y3 open and Y2 closes. When relay Y is energized, the MOR position control 74 acts as a proportional integrator. In the memory 76 (FIG. 2) the integrator 82 builds up to a voltage which is a function of the present MOR position. As the first schedule is rolled each preset MOR in the stands is at some position which is a function of the desired speed. The position error loop is open circuited, for although Y is energized (Y2 is closed) relay X is now deenergized.

When it is desired to roll a new schedule the computer 32 sends a signal to gauge control 38 and X-ray gauge 36 to set up for the new desired thickness from stand RS1. The gauge control circuit 38 then displaces hydraulic cylinder H1 in such direction as to provide the desired roll gap opening at stand RS1. When the gauge change point arrives at stand 2, relay X in stand RS1 is energized. The energizing of relay X causes the following changes to take place.

a. X1 opens so that the integrator 82 maintains its voltage and will not be affected by any further changes in the position of the preset MOR 60.
b. X2 opens removing the short on the capacitor 128 (FIG. 4). The computer 32 sends the signal (1-P.U. multiplier) to the auxiliary ramp generators 88. Only one auxiliary ramp function generator is required for all the stands.
c. X3 closes and the position error loop is now closed to the MOR position control 74.

Returning for a moment again to FIG. 6 when the P.U. multiplier is 0.933 the (1-P.U. multiplier) signal is 0.067. This signal is multiplied by the static multiplier 86. If 10 volts represents maximum stand speed say 1000 ft. per min. then the speed of 446 for stand RS1 would set the preset MOR 68 at 4.46 volts on the wiper of potentiometer 66. The summation point 78 would have as inputs +4.46v and −4.46v during schedule 1. When the gauge change transition at stand RS1 takes place, the digital computer sends the signal (1-P.U. multiplier) to the auxiliary ramp function generator 88. The input signal to the auxiliary ramp function generator is 1−0.993 = 0.067. Since 10 volts out of the auxiliary ramp function generator represents 100% change, the output here is 0.067 volts. The static multiplier multiplies 4.46 volts × 0.67 volts/10 volts = 0.29882≈0.30 volts. The position error loop sends a voltage error signal to the MOR position control 74 which causes the motor 68 to reposition the wipers on potentiometers 64, 66. The process continues until the inputs to summation point 78 are 4.46v and 4.16v. The new speed of stand RS1 is now 416. The signal out of the multiplier is negative when the stand speed is decreasing and positive when the stand speed is increasing.

When the speed of stand RS1 reaches 416, the relay X is deenergized. When the gauge change transition at stand two takes place relay X is again energized in stand 1 and a similar relay X is energized in the stand speed reference circuit for stand RS2. In this manner the speed changes are effected for each of the rolling stands as the gauge change point progresses through the mill toward the exit stand RS5. When the gauge change transition exits stand RS5, the computer at the appropriate time, changes the setting of the delivery gauge control 52 and the X-ray gauge 50.

We claim:

1. In a continuous rolling mill, a stand speed reference circuit for supplying speed reference signals to each of a plurality of selected stands respectively comprising:

speed reference means for deriving a variable potential which is a function of the respective stand speed and for delivering said speed reference signal;

means coupled to said speed reference means for storing a voltage signal which is a function of said variable potential;

first summation means for receiving said stored voltage signal, and the instantaneous magnitude of said variable potential, and for delivering a first summation signal;

a ramp function generator means for receiving a signal (1-P.U.) multiplier during gauge change transition, the P.U. multiplier being:

$$P.U. = \frac{S(i+1)1\ H(i+1)2}{S(i)1\ H(i)2}$$

where $S(i+1)1$ = the original schedule (1) speed of the transition stand;
$S(i)1$ = the original schedule (1) speed of the stand next behind the transition stand;
$H(i+1)2$ = the new schedule (2) roll gauge for the transition $(i+1)$ stand;
$H(i)2$ = the new schedule (2) roll gauge for the ith stand;

and for delivering a voltage which is a function of the incremental desired change in speed for all stands being then changed;

multiplying means connected to receive and multiply said stored voltage and said incremental desired change voltage, and for delivering a product voltage;

a second summation means connected to receive said first summation signal and said product voltage, and for delivering an error signal;

control means connected to receive a first schedule stand speed reference signal and said error signal, and for delivering a control signal to said speed reference means, the magnitude of said variable potential being successively a function of said first schedule stand reference signal and said error signal respectively;

means for controllably interrupting the connection of said first schedule stand reference signal, and said error signal to said control means, and for controllably decoupling said storing means from said variable potential, the stored voltage upon decoupling being the input to said first summation means, so that said error signal is applied to said control means only when the discrete stand speed is to be changed upon making a gauge change in the first rolling schedule.

2. A speed reference circuit according to claim 1 wherein said speed reference means is a preset stand motor operated rheostat comprising:

a motor, first and second potentiometers, said motor being coupled to said control means, and having a motor shaft coupled to the wipers of said first and second potentiometer, said wipers being ganged to be displaced in unison, the position of the wiper of said first potentiometer providing said variable potential, the potential across said second potentiometer being connected to a master ramp function generator the position of the wiper of said second potentiometer providing said speed reference signal.

3. A speed reference circuit according to claim 1 wherein said stored voltage means is an operational amplifier connected as an integrator.

4. A speed reference circuit according to claim 1 wherein said control means is an operational amplifier cooperating with said interrupting means whereby during the first rolling schedule said operational amplifier operates as an amplifier, and when the speed of the stands is being changed for the second rolling schedule it functions as a proportional integrator.

5. A speed reference circuit according to claim 1 wherein said interrupting means are a plurality of relay contacts.

6. A speed reference circuit according to claim 1 wherein a digital computer calculates and delivers the percentage change (1-P.U.) to said ramp function generators for all the stands being then changed in speed.

7. A speed reference circuit according to claim 1 wherein said multiplying means is a static multiplier.

8. In a continuous rolling mill, a stand speed reference circuit for supplying speed reference signals to each of a plurality of selected stands respectively, comprising:

a preset stand motor operated rheostat (MOR) comprising a motor, first and second potentiometers, the motor having a shaft coupled to the wipers of said first and second potentiometers, said wipers being ganged to be displaced in unison, the position of the wiper of said first potentiometer providing a variable potential which is a function of the respective stand speed, the said second potentiometer being connected to a power source, the position of the wiper of said second potentiometer providing said speed reference signal;

integrator means coupled to the wiper of said first potentiometer for storing a voltage signal which is a function of said variable potential;

first summation means for receiving said stored voltage signal and the instantaneous magnitude of said variable potential, and for delivering a first summation signal;

an auxiliary ramp function generator means for receiving a signal (1-P.U.) during gauge change transition, the magnitude of P.U. being;

$$P.U. = \frac{S(i+1)1\ H(i+1)2}{S(i)1\ H(i)2}$$

where $S(i+1)1$ = the original schedule (1) stand speed of the transition stand;
$S(i)1$ = the original schedule (1) speed of the stand next behind the transition stand;
$H(i+1)2$ = the new schedule (2) roll gauge for the transition stand $(i+1)$;
$H(i)2$ = the new schedule (2) roll gauge for the ith stand;

and for delivering a voltage which is a function of the incremental desired change in speed for all stands being then changed;

static multiplier means connected to receive and multiply said stored voltage and said incremental desired change voltage, and for delivering a product voltage;

a second summation means connected to receive said first summation signal and said product voltage, and for delivering an error signal;

operational amplifier means connected to receive a first schedule stand speed reference signal, and said error signal, and for delivering a control signal to said motor;

relay means for controllably interrupting the connection of said first schedule stand reference signal and said error signal to said operational amplifier, and for controllably decoupling said integrator means from said variable potential, the stored voltage upon decoupling being the input to said first summation means, so that during the first rolling schedule the operational amplifier acts as an amplifier only, and the error signal is applied to the operational amplifier which then acts as a proportional integrator only when the discrete stand speed is to be changed upon making a gauge change in the first rolling schedule.

* * * * *